United States Patent [19]

Sapkus et al.

[11] 4,127,251

[45] Nov. 28, 1978

[54] DOLL STAND

[75] Inventors: Jurgis Sapkus, Manhattan Beach; J. Stephen Lewis, Pacific Palisades, both of Calif.

[73] Assignee: Mattel, Inc., Hawthorne, Calif.

[21] Appl. No.: 814,022

[22] Filed: Jul. 8, 1977

[51] Int. Cl.[2] ..... F16M 11/00

[52] U.S. Cl. ..... 248/176; 248/316 D; 223/120

[58] Field of Search ..... 248/176, 316 R, 316 C, 248/316 D; 223/120, 66; 24/16 R

[56] References Cited

U.S. PATENT DOCUMENTS

| | | | |
|---|---|---|---|
| 479,481 | 7/1892 | Willcox | 223/120 |
| 2,172,682 | 9/1939 | Ravba | 248/176 |
| 2,188,701 | 1/1940 | Brullhardt | 248/176 |
| 3,567,084 | 3/1971 | Dewitt | 223/120 |
| 3,907,239 | 9/1975 | Ehrlich | 248/316 D |

FOREIGN PATENT DOCUMENTS

| | | | |
|---|---|---|---|
| 628,198 | 5/1963 | Belgium | 248/176 |

*Primary Examiner*—Robert A. Hafer

*Attorney, Agent, or Firm*—John G. Mesaros; Max E. Shirk; Stephen L. King

[57] ABSTRACT

A doll stand for supporting a doll by one leg, the stand including a base member, a clip member for gripping the lower leg in proximity to the ankle with interconnecting means between the clip member and the base. The interconnecting means include a rod member insertible within an aperture in the base and affixed to the clip member, the rod member being offset in a forward direction to provide clearance for the foot of the doll. The free end of the rod member is secured to the clip member with the rod member and clip member being angularly disposed in a direction generally perpendicular to the offset direction to provide an angle between the supporting direction of the clip and a line generally perpendicular to the base to support the doll with the center of gravity generally perpendicular to the base.

11 Claims, 11 Drawing Figures

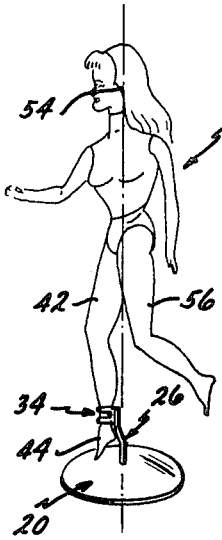
Fig. 5
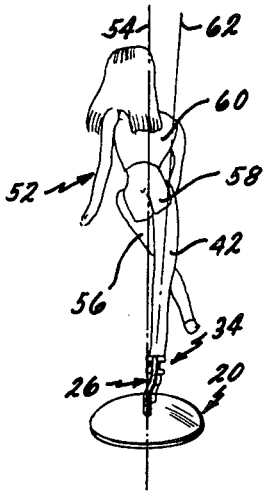
Fig. 6
Fig. 7
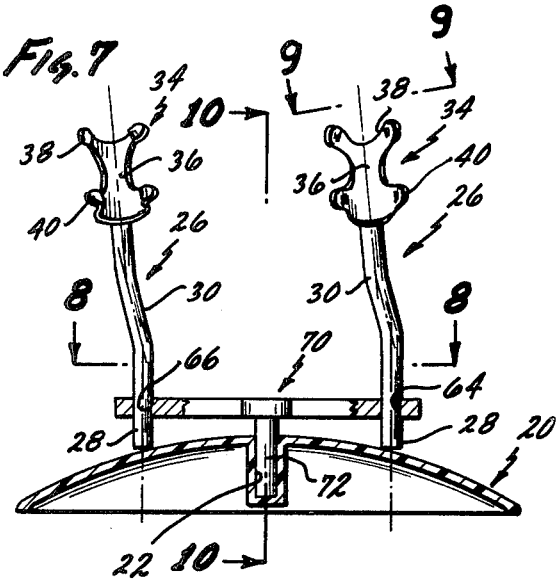
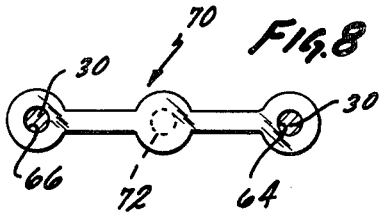
Fig. 8
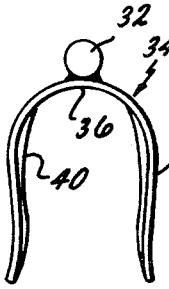
Fig. 9
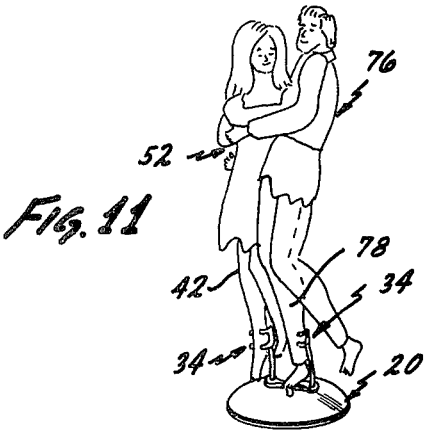
Fig. 11
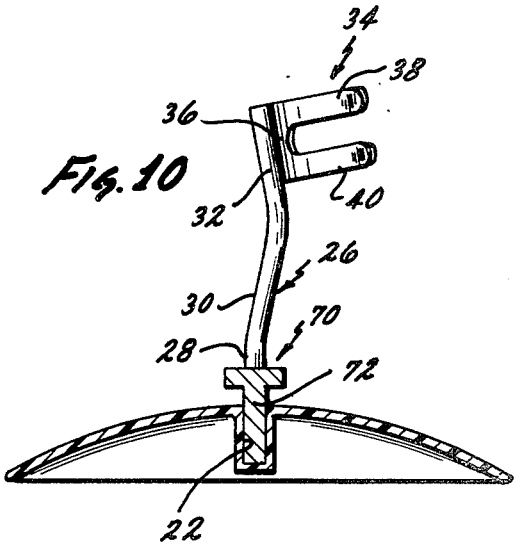
Fig. 10

DOLL STAND

BACKGROUND OF THE INVENTION

The background of the invention will be discussed in two parts:

1. Field of the Invention

This invention relates to doll stands and more particularly to a doll stand for supporting a posable doll by one leg.

2. Description of the Prior Art

Means of devices for maintaining a doll in a vertical position are desirable for displaying the doll on a shelf or the like. Such doll stands have taken many forms and one type of doll stand includes a base member with a vertically extending framework having portions adapted to grip the underarms of the doll to maintain it in a vertical position. One such stand is shown in U.S. Pat. No. 3,009,284 which also illustrates a second type of doll support which relies on the doll itself being supported on a base by means of openings in the base member for insertion of rods therein, the rods then extending through apertures within the feet of the doll. This latter type of doll support requires that the doll itself be suitably configured for this type of base and simply provides a one position doll support, that is, in a standing position only.

Other types of doll stands or doll supports have generally required that both legs of the doll be suitably restrained to provide a standing doll pose, such as shown in U.S. Pat. Nos. 3,516,632 and 3,675,362. In the first of the two referenced patents, the doll stand engages both legs adjacent the hips with the dress of the doll suitably covering the framework. In the second of the two references, the feet and legs are suitably restrained below the knees in a supporting structure having a platform with a peripheral flange for restraining the toe members with a pair of leg receiving recesses in a spaced member adapted for receiving the legs below the knees. Other doll supporting devices are illustrated in the patents listed in a separate letter to the Patent Office, which letter accompanies this application.

Generally, such prior art doll support devices have limited play value since the construction is usually adapted for supporting the doll in one position. With the advent of posable dolls, that is, dolls with bendable legs and arms coupled with pivoting movement of the legs, arms and torsos, such doll supports have not admitted the child to fully utilize the posability of the doll in a supported position while posed.

Accordingly, it is an object of this invention to provide a new and improved doll stand which permits posing of the doll in many positions while so-supported by the stand.

It is a further object of this invention to provide a new and improved doll stand for posing two dolls in relation to each other.

SUMMARY OF THE INVENTION

The foregoing and other objects of the invention are accomplished by providing a doll stand for supporting a doll by one leg with the center of gravity of the doll in alignment with a line generally perpendicular to the plane of a base member. A clip member releasably receives a lower portion of one leg of the doll and interconnecting means couple the clip member to the base in spaced relation to the base. The interconnecting member is a rod member having one end thereof secured to the clip, the rod member being configured to provide an offset in a first direction, the offset being intermediate the clip and the base to provide clearance for the portion of the leg intermediate the clip member and the base. The clip member and the rod member are angularly disposed in a direction generally perpendicular to the direction of the offset to support the leg at an angle to a line perpendicular to the plane of the base. In a first embodiment, the other end of the rod member is inserted within an aperture in the base for supporting one doll. In a second embodiment, two clip members and rod members are provided with the free end of each of the rod members being affixed to the outer ends of a cross member which has a centrally disposed projection insertable within the aperture of the base, this arrangement supporting one leg of each of two dolls which can then be in posed relation with respect to each other.

Other objects, features and advantageous of the invention will become apparent upon a reading of the specification when taken in conjunction with the drawings in which like reference numerals refer to like elements in the several views.

BRIEF DESCRIPTION OF THE DRAWINGS

FIG. 5 is a side view showing the doll stand supporting a doll in a posed animated position;

FIG. 6 is a rear view showing the doll stand supporting a doll in a different posed position;

FIG. 7 is a front view partially in cross section, of a second embodiment of the doll stand according to the invention;

FIG. 8 is a top plan view of the cross member utilized in the doll stand of FIG. 7 as viewed generally along line 8—8 thereof;

FIG. 9 is a plan view of the clip member used in the doll stand of FIG. 7 as viewed generally along line 9—9 thereof;

FIG. 10 is a cross-sectional view of the doll stand of FIG. 7 taken along line 10—10 thereof; and FIG. 11 is a perspective view of the doll stand of FIG. 7 supporting two dolls in posed relation thereon.

DESCRIPTION OF THE PREFERRED EMBODIMENT

Figure 1:
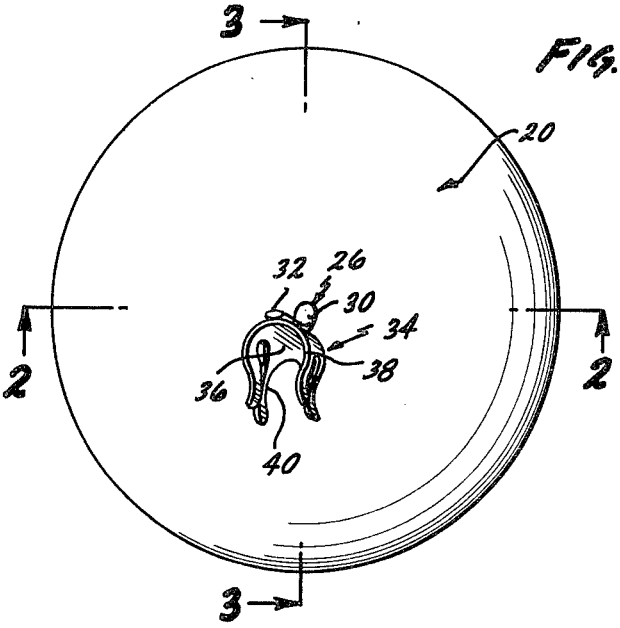
FIG. 1 is a top elevational view of the doll stand according to the invention.
Figure 2:
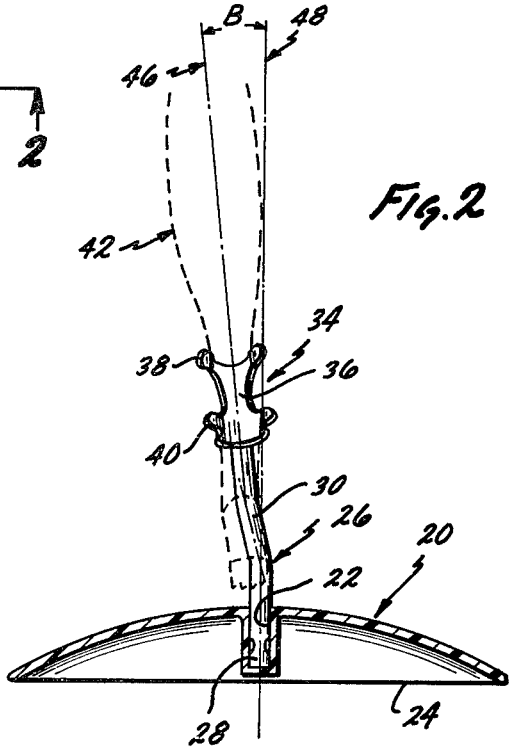
FIG. 2 is a front view of the doll stand of FIG. 1 with the base thereof in cross section taken along line 2—2 of FIG. 1.
Figure 3:
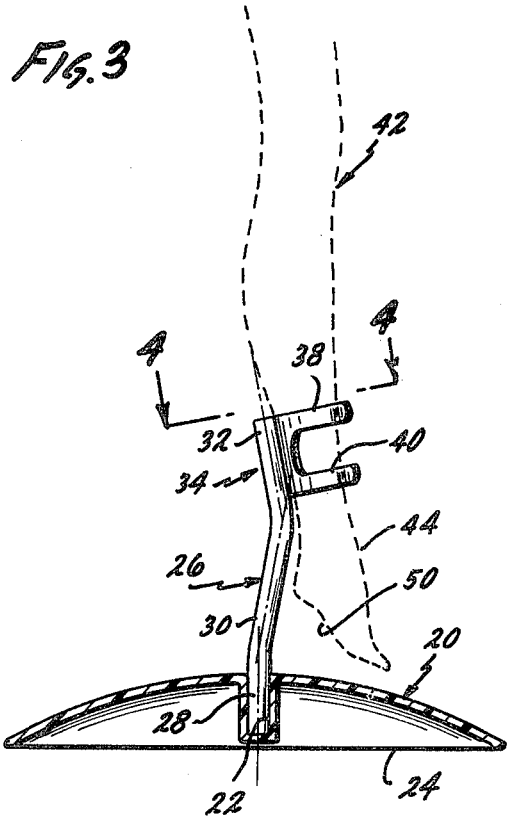
FIG. 3 is a side elevation of the doll stand of FIG. 1 with the base thereof in cross section taken along line 3—3 of FIG. 1.
Figure 4:
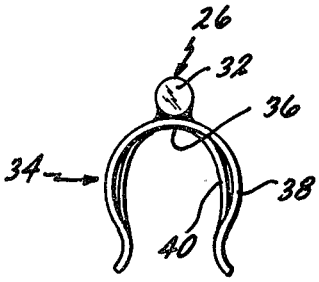
FIG. 4 is a top plan view of the clip member viewed along line 4—4 of FIG. 2.

Referring now to the drawings and particularly to FIGS. 1–4, there is shown a doll stand according to the invention which includes a base member 20 which is of an inverted generally dish-shaped cross section with a centrally disposed aperture or recess 22 formed therein. The base 20 is adapted for positioning on a supporting surface such as a table or the like with the center line of the recess 22 being generally perpendicular to the plane of the bottom edge 24 of the base 20. Inserted within the recess 22 is a rod member generally designated 26 which has a first portion 28 configured for matingly engaging the recess 22. The rod member has a second portion 30 and a third portion 32, the third portion 32 being the other end of the rod member 26 and having secured thereto a clip member generally designated 34 which has an arcuately configured main spine portion with upper and lower clip means 38 and 40 formed integrally therewith. As shown in FIG. 4, the upper clip 38 is generally horseshoe-shaped in cross section with a generally circular opening of a diameter sufficient to engage a leg 42 (shown in dotted lines in FIGS. 2 and 3) at the calf or just above the ankle 44 of the leg 42. The lower clip 40 defines a narrower elongated type opening for engaging the smaller cross section portion of the ankle 44. The spine 36 of the clip member 34 is formed integral with or secured to the rod member 26 at portion 32 thereof and, as shown in FIG. 2, the center line 46 extending through the clip member 34 which is the approximate geometric center of the leg 42 is angularly displaced with respect to a line 48 which is perpendicular to the plane of the base 20 defined by the bottom edge 24 thereof, this angle being designated "B". The angular disposition of angle B is accomplished by aligning the spine 36 of the clip member 34 with respect to the rod member 26 in the embodiment shown by having the interconnecting means or rod member 26 configured with the intermediate portion 30 thereof at an angle to the free end 28 with the spine 36 of clip member 34 in general alignment with the other end 32 thereof. Alternatively, the free end 28 can be in a common plane with the intermediate portion 30 as viewed in FIG. 2 with the recess 22 being angularly disposed with respect to the center of the base member 20. In either event, the clip member 34 is positioned with respect to base member 20 by interconnecting means so that, as viewed from the front in FIG. 2, the longitudinal center line of the leg 42 is maintained within the clip member 34 through some angle B with respect to a vertical line 48.

In the doll stand shown in the drawings, the right leg of the doll is the leg intended to be supported by the clip member 34. However, it is to be understood that by angularly positioning the clip member 34 on the opposite side of the vertical line 48, the present doll stand applies equally to supporting the doll by the left leg and in either event, the center of gravity of the doll is on a line generally perpendicular to the plane of the base 20.

In addition, as viewed in FIG. 3, the interconnecting rod member 26 is bent or offset in the forward direction, that is, in a direction generally perpendicular to the direction of the angular displacement of angle B shown in FIG. 2. This offset, as shown in FIG. 3 is accomplished by inclining the intermediate portion 30 of rod member 26 in a direction forward of portion 28 with the portion 32 being inclined upwardly and rearwardly of the end of portion 30. By offsetting the clip member 34 in this manner, clearance is provided for the foot 50 of the leg 42 of the doll, this clearance being for the portion of the leg 42 intermediate the clip member 34 and the surface of base 20. In this manner, if the foot 50 should have high heel shoes or the like placed thereon the shoes would terminate in proximate relation to the base 20 while the clip member 34 would still frictionally engage the leg 42 for supporting the doll.

As better illustrated in FIGS. 5 and 6, a doll generally designated 52 has the ankle 44 of the right leg 42 thereof engaging the clip member 34 for supporting the doll 52 in an upright position relative to the base 20. The broken line designated 54 extending through the longitudinal axis of the doll 52 generally extends through the center of the dished surface of base 20 and the doll 52 is in its most stable position with the center of gravity thereof positioned on line 54 or in proximate relation thereto. The offset in the forward direction of the clip member 34, in addition to providing clearance for the foot 44 of the doll 52, also serves to position the main mass of the doll above the supporting connection of the rod member 26 within the base 20.

As viewed in FIG. 5, the doll 52 is posed in a walking or running position with the right leg 42 in apparent ground contact relation to the left leg 56 which is thrust rearwardly and bent at the knee to simulate a lifelike walking or running position. The pose of the doll in this position provide optical physical balance, that is, the appearance of the doll 52 when so-posed, simulates a natural movement. This lifelike appearance is further illustrated in FIG. 6 wherein the torso of the doll is divided into a lower torso 58 and upper torso 60, the torso members being pivotable with respect to each other and with the legs 42 and 56 being pivotable with respect to the lower torso 58. In this view, the upper torso 60 has been rotated with respect to the lower torso 58 and the left leg 56 has been thrust well forward and across the front of leg 42 to pose the doll 52 in a dancing position. With the longitudinal axis of the right leg 42 extending along the broken line 62 the position of the center of the lower torso 58 is somewhat constrained due to the restraint of the ankle of leg 42. Upon positioning of the movable parts of the doll 52 with respect to each other in any one of a number of poses including that illustrated in FIG. 6, the optical physical balance of the doll as posed is maintained with the aesthetic center of mass of the doll 52 being positioned generally along a line 54 which is vertical and generally perpendicular to the plane of the base 20.

A second embodiment of the doll stand is shown in FIGS. 7–10 wherein two clip members 34 are illustrated in spaced aligned relationship with the lower ends 28 thereof being inserted into apertures 64 and 66 formed in opposite ends of an interconnecting cross member generally designated 70. The cross member 70 is provided at its mid-point with a downwardly depending projection 72 matingly engaging the recess 22 formed in base 20 with the main body portion of cross member 70 being generally parallel to the plane of base 20 with the end portion 28 of rod members 26 extending in a direction generally perpendicular to the plane of the main body portion of cross member 70. The interconnecting members or rod members 26 are identically configured and include the lowermost portions 28, the intermediate portions 30 and the opposite end portions 32 to which the clip members 34 are suitably affixed with the overall configuration being to angularly disposed clips 34 in the same direction at an angle to a line drawn through the centers of portions 28 of rod members 26. As can be seen in FIG. 9, the upper clip portions 38 have a larger opening than the clip portions 40 of clip member 34 to accomodate the differing cross-sectional contours of the leg so-engaged.

By utilization of two clip members 34 in the embodiment shown in FIG. 7, the posing of two dolls 52 and 76 as illustrated in FIG. 11 by one doll stand is possible. As shown in FIG. 11, the base member 20 has the clip members 34 of the doll stand suitably engaging the right legs 42 and 78 of the dolls 52 and 76, respectively, to pose the female doll 52 with the male doll 76 in a dancing position which is optically physically balanced to simulate lifelike positions of the so-posed dolls. As can be seen by the provision of a doll stand which engages the lower portion of one leg only of a doll with the angular disposition of the so-engaged leg maintaining the optical center of mass of the doll in proper alignment with the base, a large variety of lifelike poses are obtainable with currently available posable dolls having bendable and pivotable limbs with positionable heads and two-part rotatable torso members. Although the description hereinabove has described a separate base member 20, it is to be understood that the base member can include any surface of a doll setting with an opening or aperture for receiving the lower end 28 of the rod member 26 or the projection 72 of the doll stand for supporting two dolls. Such surfaces may include for example stairs, a stage platform, the floor of a doll house or the like which may be adapted for use with to doll. Similarly, in the embodiment illustrated in FIG. 7, one clip member 34 with its corresponding rod member 26 can be configured for receiving the right leg of one doll while the other clip member 34 with its corresponding rod member 26 can be configured to receive the left leg of the other doll and additionally, the rod members 26 can be made separable from the cross member 70 as well as rotatable within cross member 70 to pose the dolls in other simulated lifelike positions.

While there has been shown and described a preferred embodiment it is to be understood that various other adaptations and modifications may be made within the spirit and scope of the invention.

What is claimed is:

1. In a stand for supporting a doll, the combination comprising:

A base;

a clip member for releasably receiving a lower portion of one leg of the doll; and a rod member coupled to said clip member and to said base, said rod member having an offset in a first direction for providing clearance for the portion of the leg intermdiate said clip member and said base, said rod member being angularly disposed in a direction generally perpendicular to the direction of said offset for supporting the leg at an angle to a line perpendicular to the plane of the base, the angle being in a direction for supporting the doll by said one leg with the center of gravity of the doll in general alignment with a line perpendicular to the base.

2. The combination according to claim 1 wherein said clip member is secured to the upper end of said rod member.

3. The combination according to claim 2 wherein said base has an aperture and said rod member has the lower free end thereof inserted in said aperture.

4. The combination according to claim 3 wherein said clip member has upper and lower spaced clip portions, said clip portion having a larger opening than said lower clip portion, said clip portions being configured to engage the lower leg of the doll in proximity to the ankle thereof.

5. The combination according to claim 1 wherein said doll stand further includes a second substantially identical clip member and rod member, and said stand includes interconnecting means for coupling both of said clip members and rod members to said base.

6. The combination according to claim 5 wherein said first and second clip members are in spaced relation for gripping one leg of each of two dolls whereby to support two dolls in posed relation with respect to each other on said base.

7. The combination according to claim 6 wherein said interconnecting means include a cross bar having a centrally disposed projection coupled to said base.

8. The combination according to claim 7 wherein said interconnecting means further includes rod means interconnecting said clip members and the free ends of said cross member.

9. The combination according to claim 8 wherein each of said rod members is offset in a first direction to provide clearance for the portion of the leg intermediate said clip member and said base.

10. The combination according to claim 9 wherein each of said rod members is angularly disposed in a second direction generally perpendicular to the direction of said offset to provide said angle.

11. The combination according to claim 10 wherein each of said rod members is angularly disposed in the same direction whereby to support the same leg of both dolls.

* * * * *